United States Patent [19]

Speranza et al.

[11] Patent Number: 4,735,746

[45] Date of Patent: Apr. 5, 1988

[54] LONG LASTING DETERGENT BAR CONTAINING A POLYAMIDE OR POLYESTER POLYMER

[75] Inventors: George P. Speranza; Terry L. Renken, both of Austin, Tex.

[73] Assignee: Texaco Inc., White Plains, N.Y.

[21] Appl. No.: 29,111

[22] Filed: Mar. 23, 1987

Related U.S. Application Data

[63] Continuation-in-part of Ser. No. 874,726, Jun. 16, 1986, abandoned.

[51] Int. Cl.[4] ..... C11D 3/37; C11D 9/30; C11D 11/04; C11D 17/00

[52] U.S. Cl. ..... 252/544; 252/117; 252/134; 252/174; 252/174.21; 252/174.23; 252/DIG. 2; 252/DIG. 3; 252/DIG. 5; 252/DIG. 16

[58] Field of Search ..... 252/90, 91, 92, 117, 252/134, 174, 174.21, 174.23, 544, DIG. 15, DIG. 2, DIG. 16; 424/19, 78

[56] References Cited

U.S. PATENT DOCUMENTS

| | | | |
|---|---|---|---|
| 3,383,320 | 5/1968 | Bell | 252/132 |
| 3,563,902 | 2/1971 | Schmadel | 252/544 |
| 3,563,904 | 2/1971 | Schmadel | 252/544 |
| 3,563,905 | 2/1971 | Schmadel | 252/544 |
| 3,654,167 | 4/1972 | Akrongold | 252/119 |
| 3,663,444 | 5/1972 | Scmadel | 252/99 |
| 3,882,090 | 5/1975 | Fagerburg | 528/338 |
| 4,020,015 | 4/1977 | Bevan | 252/544 |
| 4,132,680 | 1/1979 | Nicol | 252/547 |
| 4,193,887 | 3/1980 | Stone | 252/91 |
| 4,208,198 | 6/1980 | Kenkare | 252/117 |
| 4,217,324 | 8/1980 | Meek | 264/236 |
| 4,320,213 | 3/1982 | Woodbrey | 525/179 |
| 4,323,656 | 4/1982 | Strickman | 521/109 |
| 4,554,097 | 11/1985 | Schebece | 252/542 |

*Primary Examiner*—Dennis Albrecht

*Attorney, Agent, or Firm*—Jack H. Park; Kenneth R. Priem; Richard A. Morgan

[57] ABSTRACT

A water-soluble polyamide or polyester is prepared or melted in the presence of a surface active agent. The polyamide or polyester is present in an amount of 5 to 95 wt % with the surfactant as the major portion of the balance. The composition is molded or shaped into long lasting detergent bars.

In the specified range, compositions with more surface active agent are more suitable for detergent bars. Compositions with more polymer are more suitable for toys or shaped or molded articles.

23 Claims, No Drawings

LONG LASTING DETERGENT BAR CONTAINING A POLYAMIDE OR POLYESTER POLYMER

CROSS-REFERENCE TO RELATED APPLICATION

This application is a continuation-in-part of application Ser. No. 874,726 filed June 16, 1986. Now abandoned.

BACKGROUND OF THE INVENTION

1. Field of the Invention

This invention relates to long lasting detergent bars. More particularly, the invention relates to a composition of heat stable, water-soluble polymers distributed through a surfactant bar. Polymerization of water-soluble polyamides or polyesters in the presence of a surface active agent or melt blending produces a persistent, though water-soluble composition which can be molded or shaped as detergent bars, toys and other useful articles.

2. Description of the Useful Arts

Detergent or soap bars have long been used for washing the human body, laundering clothing or cleaning kitchenware. The solid bar is a convenient means of dispensing the surface active agent at the point of use. These solid bars have comprised additional components, such as abrasives to enhance the cleaning qualities of the bar.

U.S. Pat. No. 4,190,550 describes a soap-filled pad. Needled and crimped synthetic organic fibers are imbedded in a solid soap core. The synthetic fibers may comprise nylon fibers 150 to 200 microns in diameter and 3 cm. in length and may be oriented to provide resilience and strength. Thinner, supple acetate rayon fibers of 20 to 50 micron diameters are more suited to bathing.

U.S. Pat. No. 3,949,137 describes a unitary body sponge having a selected porosity, impregnated with a gel material comprising synthetic detergents or soap. The sponge contains 70 to 200 pores per square inch.

Surface active agents have properties which make them useful for applications other than washing. They are known for their use as mold release or solubility agents.

U.S. Pat. No. 4,217,324 describes the use of a surfactant to uniformly disperse a lubricant through molten nylon during molding to produce an antifriction nylon member. The surfactant has no function once the molten nylon member has cooled and solidified.

U.S. Pat. No. 4,320,213 describes the use of a surfactant as an emulsifier in the polymerization of a polyamide resin with an elastomer. The molded product is a high impact polyamide suitable for automotive parts, gears and the like.

U.S. Pat. No. 3,882,090 describes the use of linear water-soluble polyamides having ether linkages in the polymer chain which are used as textile sizing agents, coatings and adhesives.

U.S. Pat. No. 3,654,167 describes water insoluble polyamides made from fatty acids, diacids, triacids, etc. with aliphatic, cycloaliphatic or aromatic diamines.

U.S. Pat. No. 4,193,887 describes polyurethane sponges containing alkyl aryl sulfonate detergents. The polyol and detergent are mixed and then allowed to react with a polyisocyanate in the presence of water. The polyols are water insoluble and so is the polyurethane. The products are water insoluble flexible urethane foams filled with detergent.

U.S. Pat. Nos. 4,207,198 and 4,554,097 describe an improved elastic bar and elastic detergent product which comprises an organic detergent with gelatin and a lower di- or polyhydric alcohol.

U.S. Pat. No. 4,323,656 describes sponges made by entraping soaps in the sponge using diisocyanates and polyethers or polyester. The sponges are not water-soluble, nor are they polyamides or polyesters.

SUMMARY OF THE INVENTION

The invention is a long lasting detergent bar. The bar comprises 5 to 95 wt % of a condensation polymer selected from the group consisting of water-soluble polyamides, polyesters and mixtures thereof polymerized in the presence of a surface active agent. Alternatively, the condensation polymer can be melt blended with a highly dispersed surface active agent.

DESCRIPTION OF THE PREFERRED EMBODIMENTS

Heat stable, water-soluble condensation polymers are synthesized in the presence of a surfactant or soap to form a long lasting detergent bar or shaped article. The surfactants may be liquid or solid. If the surfactant is not sufficiently heat stable, the surfactant is blended through the melted water-soluble condensation polymer. However it is preferred if possible that the monomer be dispersed through and polymerized in the presence of the surfactant.

In the examples, 1:1 salts of polyalkylene glycol diamines and dicarboxylic acids are mixed with various surfactants and the mixtures heated at 200° C. and above to liberate water and form the water-soluble polyamide polymer-detergent bars on cooling. The condensation polymer of adipic acid with diamine-dibasic acid salts is preferred. Alternatively, the bars may be formed by melt blending the polymer with the surfactant and allowing the composition to cool.

When used, the polymer and surfactant are washed away simultaneously, dispensing the encapsulated surfactant. The rate at which the bar is washed away depends upon the solubility of the polymer and the rate at which the polymer dissolves. Accordingly the invention lends itself to unsupervised industrial washing operations where a controlled dispensing rate is required. The relative amount of constituents is selected by routine testing procedures to give the required rate.

Water-Soluble Polyamides

The dicarboxylic acid components from which the water-soluble polyamides are prepared are adipic acid, glutaric acid, pimelic acid, oxydiacetic acid, oxyalkylene derivatives of oxydiacetic acid and esters and ammonium salts thereof and mixtures thereof. Adipic acid is preferred for economy. Additionally, it has been found that the incorporation of amounts of insoluble polyamides (e.g. based on sebacic acid in Example 7) is useful in improving some of the desirable properties of the detergent bar.

The diamine may incorporate a (alkyleneoxy)bis(-propylamine) having the formula: $H_2N—C_3H_6—(OR)_n—O—C_3H_6—NH_2$, wherein R is ethylene, 1,2-propylene or 1,3-propylene and n is an integer of 2 to about 13. Examples of suitable diamine components of this invention are 3,3'-(diethylenetrioxy)bis(propylamine), 3,3'-(tetraethylenepentaoxy)bis(propylamine), 3,3'-

(pentaethylenehexaoxy)bis(propylamine), 3,3'-(triethylenetetraoxy)bis(propylamine). Generally only the diamines derived from cyanoethylated diethylene glycol and higher ethyleneoxy glycols such as tri, tetra-, penta-ethylene glycols or higher polyethylene glycols, etc. are useful. Copolyamides may, of course, be made using diamines that either do or do not contain ether oxygens, the limit of modifications being determined by the melting point and water solubility of their products. The major requirement being the ratio of oxyalkylene to amide linkages in the final polyamide should be from about 3:2 to about 14:2. Examples of other diamines which may be used in small amounts are hexamethylene diamine, bis-diaminodiethyl ether, 1,4-(cyclohexane)-bis(methylamine), tetramethylene diamine and diamines of the general formula $NH_2(CH_2)_nNH_2$ where n ranges from 2 to 10.

Higher molecular weight alkylene glycol diamines may be, for example those having the formula: $H_2NRNH_2$, wherein the radical R is a polyoxyalkylene chain of molecular weight of from 600 to 2500 having terminal carbon atoms to which nitrogen atoms are bonded. The radical R has the formula:

$$-(CH(CH_3)CH_2O)_y(CH_2CH_2O)_z(CH_2CH(CH_3)O)_{y-1}CH_2CH(CH_3)-$$

wherein y ranges from 1 to 5 preferably 1 to 3 and z ranges from 1 to 50, preferably 1 to 3.

Diamines of this type are marketed by Texaco Chemical Co., Inc., Houston, Tex. under the trademark Jeffamine® ED-series. Typical polyoxyalkylenediamines which are commercially available and useful for producing water-soluble polyamides include:

a. The diterminal diamine of mixed polyoxypropylene and polyoxyethylene of molecular weight 600. As marketed under the trademark Jeffamine® ED-600, the average value of the formula of y is 1.50 and of z is 8.70.

b. The diterminal diamine of mixed polyoxypropylene and polyoxyethylene of molecular weight 900. As marketed under the trademark Jeffamine® ED-900, the average value in the formula of y is 1.50 and of z is 15.6.

c. The diterminal diamine of mixed polyoxypropylene and polyoxyethylene of molecular weight 2000. As marketed under the trademark Jeffamine® ED-2001, the average value in the formula of y is 1.50 and of z is 41.8.

Other higher molecular weight alkylene glycol diamines are made by adding acrylonitrile to glycols and then hydrogenating the adduct. These diamines have the formula: $H_2NRNH_2$, wherein R is a polyoxyalkylene chain of molecular weight of 600 to 5000 having terminal carbon atoms to which nitrogen atoms are bonded. The radical has the formula:

$$-CH_2CH_2CH_2O-(CH_2CH_2O)_xCH_2CH_2CH_2-$$

wherein x ranges from 1 to 100, preferably 1 to 3.

The preferred polyamide is the condensation product of triethylene glycol diamine with adipic acid. Adipic acid may be condensed with other diamines which include polyoxyethylene diamines such as tetraethylene glycol diamine and higher molecular weight alkylene glycol diamines. The alkylene glycol diamine must be selected for its ability to impart water solubility in the resulting condensation polymer. Several anomalies exist. For example, the polyamide from oxalic acid and triethylene glycol diamine is water insoluble, while that from oxalic acid and tetraethylene glycol diamine is water-soluble.

The preferred weight ratio of polyamide: surface active agent is 2:1 to 1:4.

Water-soluble polyesters may include those prepared from oxyalkylene homologues of oxydiacetic acid of the formula:

$$HOOCCH_2O(CH_2CH_2O)_xCH_2COOH$$

wherein x ranges from 0 to 5.

Water-soluble polyester polyamide blends may also be used, but are not as suitable as polyamides alone made from alkylene glycol diamines condensed with dibasic acids.

Water-Soluble Polyesters

We have found fewer water-soluble polyesters than water-soluble polyamides. Heretofore, polyesters have been investigated for their water insoluble characteristics. Most polyesters are water insoluble. However, a short series of water-soluble polyesters can be made from products such as A and B:

$$H(OCH_2CH_2)_xO-CH_2COOH \quad (A)$$

(B)

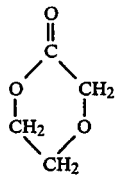

Surfactants

An essential ingredient of detergent bars of the present invention is a suitable surfactant. The surfactants are broadly defined as surfactants selected from the group consisting of anionic, nonionic, ampholytic, zwitterionic, and cationic surfactants and soap.

Anionic surfactants operable in compositions suitable for use in the present invention can be broadly described as the water-soluble salts, particularly the alkali metal salts, of organic sulfuric acid reaction products having in their molecular structure an alkyl or alkaryl radical containing from about 8 to about 22 carbon atoms and a radical selected from the group consisting of sulfonic acid and sulfuric acid ester radicals. The term alkyl is intended to include the alkyl portion of higher acyl radicals. Important examples of the anionic surfactants which can be employed in the practice of the present invention are the sodium or potassium alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 9 to about 15 carbon atoms, (the alkylradical can be a straight or branched aliphatic chain); paraffin sulfonate surfactants having the general formula $RSO_3M$, wherein R is a primary or secondary alkyl group containing from about 8 to about 22 carbon atoms (preferably 10 to 18 carbon atoms) and M is an alkali metal, e.g., sodium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl in which the fatty acids, for example, are derived from coconut oil and sodium or potassium -acetoxy- or -acetamido-alkanesulfonates where the alkane has from 8 to 22 carbon atoms.

Nonionic surfactants which can be used in practicing the present invention can be of three basic types: the alkylene oxide condensates, the amides and the semipolar nonionics.

The alkylene oxide condensates are broadly defined as compounds produced by the condensation of alkylene oxide groups (hydrophilic in nature) with an organic hydrophobic compound, which can be aliphatic or alkyl aromatic in nature. The length of the hydrophilic or polyoxyalkylene radical which is condensed with any particular hydrophobic groups can be readily adjusted to yield a water-soluble-compound having the desired degree of balance between hydrophilic and hydrophobic elements.

Examples of such alkylene oxide condensates include:

1. The condensation products of aliphatic alcohols with ethylene oxide. The alkyl chain of the aliphatic alcohol can either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol® 15-S-9 marketed by the Union Carbide Corporation. Neodol® 23-6.5 marketed by the Shell Chemical Company and Kyro EOB® marketed by the Procter & Gamble Company.

2. The polyethylene oxide condensates of alkyl phenols. These compounds include the condensation products of alkyl phenols having an alkyl group containing from about 6 to about 12 carbon atoms in either a straight chain or branched chain configuration, with ethylene oxide, the said ethylene oxide being present in amounts equal to 5 to 25 moles of ethylene oxide per mole of akyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal® CO-610 marketed by the GAF Corporation; Tritol® X-45, X-114, X-100 and X-102, marketed by the Rohm and Haas Company and Surfonic® N-85, N-95 and N-120 marketed by Texaco Chemical Co.

3. The condensation products of ethylene oxide with a hydrophobic base formed by the condensation of propylene oxide with propylene glycol. The hydrophobic portion of these compounds has a molecular weight of from about 1500 to 1800 and is water insoluble. The addition of polyoxyethylene moieties of the hydrophobic portion tends to increase the water-solubility of the molecule. Examples of compounds of this type include certain of the commercially available Pluronic® surfactants marketed by Wyandotte Chemicals of BASF.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40% to about 80% by weight of polyoxyethylene and has a molecular weight of from about 5000 to about 11,000. Examples of this type of nonionic surfactant include certain of the commercially available Tetronic® compounds marketed by BASF.

Examples of the amide type of nonionic surfactants include the ammonia, monoethanol and diethanol amides of fatty acids having an acyl moiety of from about 8 to about 18 carbon atoms. These acyl moieties are normally derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process.

Examples of the semi-polar type of nonionic surfactants are the amine oxides, phosphine oxides and sulfoxides.

Ampholytic surfactants which can be used in practicing the present invention can be broadly described as derivatives of aliphatic amines which contain a long chain of about 8 to about 18 carbon atoms and an anionic water-solubilizing group, e.g., carboxy, sulfo and sulfato. Examples of compounds falling within this definition are sodium-3-dodecylamino-propionate, sodium-3-dodecylamino propane sulfonate, and dodecyl dimethylammonium hexanoate.

Zwitterionic surfactants which can be used in practicing the present invention are broadly described as internally-neutralized derivatives of aliphatic quaternary ammonium and phosphonium and tertiary sufonium compounds, in which the aliphatic radical can be straight chain or branched, and wherein one of the aliphatic substituents contains from about 8 to about 18 carbon atoms and one contains an anionic water-solubilizing group, e.g., carboxy, sulfo, sulfaro, phosphato, or phosphono.

Cationic surfactants which can be used in practicing the present invention include stearyl dimethyl benzyl ammonium chloride, coconut dimethyl benzyl ammonium chloride, cetyl pyridinium chloride and cetyl trimethyl ammonium chloride.

Hypochlorite-stable surfactants which are especially resistant to oxidation are the alkyl sulfates and paraffin sulfonates. Alkyl sulfates are the water-soluble salts of sulfated fatty alcohols containing from about 8 to about 18 carbon atoms in the alkyl group. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant surfactant/dye compositions include sodium lauryl alkyl sulfate, sodium stearyl alkyl sulfate, sodium palmityl alkyl sulfate, sodium decyl alkyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixutres of these surfactants. Highly preferred alkyl sulfates are sodium coconut alkyl sulfate, potassium coconut alkyl sulfate, potassium lauryl alkyl sulfate and sodium lauryl alkyl sulfate.

Paraffin sulfonate surfactants have the general formula $RSO_3M$, wherein R is a primary or secondary alkyl group containing from about 8 to about 22 carbon atoms (preferably 10 to 18 carbon atoms) and M is an alkali metal, e.g., sodium or potassium. Paraffin sulfonate surfactants and methods for their preparation are well known in the art. They may be prepared, for example, by reaction of hydrocarbons with sulfur dioxide, oxygen and a sulfonation reaction initiator. Alternatively, they may be prepared by reacting an alkene and a sodium bisulfite under suitable radiation or catalysis. Paraffin sulfonate surfactants are commercially available, e.g., from Farbwerke Hoechst A.G.

Preferred paraffin sulfonates herein are secondary paraffin sulfonates. Examples of specific paraffin sulfonates herein are:

Sodium-1-decane sulfonate;
Potassium-2-decane sulfonate;
Lithium-1-dodecane sulfonate;
Sodium-6-tridecane sulfonate;
Sodium-2-tetradecane sulfonate;
Sodium-1-hexadecane sulfonate;
Sodium-4-octadecane sulfonate;
Sodium-3-octadecane sulfonate.

Normally, the paraffin sulfonates are available as mixtures of individual chain lengths and position isomers, and such mixtures are suitable for use herein.

The term "soap" as used herein is meant to designate alkali metal soaps such as the sodium and potassium salts of the higher fatty acids of naturally occurring plant or animal esters, e.g., palm oil, coconut oil, babassu oil, soybean oil, castor oil, tallow, synthetic whale and fish oils, grease and lard and mixtures thereof. Sodium and potassium soaps can be made by direct saponification of the fats and oils or by the neutralization of the fatty acids which are prepared in a separate manufacturing process. Examples of suitable soaps are the sodium, potassium, ammonium and alkylolammonium salts of higher fatty acids ($C_{10}$–$C_{20}$). Particularly useful are the sodium and potassium salts of the mixtures of fatty acids derived from coconut oil and tallow, i.e., sodium or potassium tallow and coconut soap.

In some cases, the polyamide or polyester is incompatible within a surfactant. Surfonic® N-85 surfactant is incompatible with glutaric-triethylene glycol diamine polyamide. In such a case, some of the diamine can be replaced with another, more compatible diamine. This is accomplished by serial compatibility testing.

The composition of the instant invention may also include, in addition to conventional detergents, builders, brighteners, hydrotropes, germicides, soil suspending agents, anti-redisposition agents, antioxidants, bleaches, coloring materials, perfumes, water-soluble alcohols, foam boosters, abrasives, etc.

Detergent Bar Manufacture

The manufacture of solid bars from the compositions of the present invention is well within the capability of persons of ordinary skill in the art of forming bars of toilet soap. The surfactant bars described herein are manufactured by mixing the raw materials into a homogeneous mass and molding, extruding, cutting and stamping the mass to form uniform bars or cakes.

The manufacture is accomplished by apparatus well known in the art. These are described; for example, in U.S. Pat. Nos. 4,201,743; 4,453,909; 4,438,010; 4,515,707 and 4,521,541.

This invention is described by way of example.

EXAMPLE 1

(a) Preparation of Triethylene Glycol Diamine-Adipic Acid Salt

To a two liter 3-necked flask was added 71.6 g (0.49 moles) of adipic acid and 550 ml of methanol. The flask was equipped with a stirrer, thermometer and a 500 ml addition funnel. Then 74.1 g (0.50 moles) of triethylene glycol diamine (TEGDA) were dissolved in 350 ml of methanol and a slight exotherm was observed. The diamine/methanol solution was added to the acid solution with stirring over a 15-minute period. The temperature increased from 20° to 38° C. No salt precipitated even after cooling for 24 hours at 0° C. The solution was placed in a 5 liter flask and one liter of isopropanol was added over a 10 minute period. Initially no precipitation occurred, but suddenly crystallization began and a voluminous quantity of white salt formed. The salt was dried under vacuum at 60° C. to give 135.8 g of white solid melting 141.5°–142.5° C.

(b) Polymerization of Triethylene Glycol Diamine-Adipic Acid Salt in Presence of Liquid Detergent Into a 250-ml 3-necked flask equipped with a stirrer, thermometer and nitrogen inlet was added 50.0 g of the salt prepared in (a) and 50.0 g of Surfonic® N-85 detergent. Surfonic® N-85 is the 8.5 mole ethylene oxide adduct of nonylphenol, made by Texaco Chemical Co. The flask was purged with nitrogen for 15 minutes and then heated. The following data were recorded.

| Time, Min | Temp., °C. | Comments |
|---|---|---|
| 0 | 24 | Heat on |
| 35 | 140 | Melted, stirrer on, water coming off |
| 40 | 180 | Yellow melt |
| 70 | 185 | — |
| 115 | 250 | Heat off |
| 170 | 210 | Solidification, increased temp. |
| 205 | 240 | Lifted stirrer out of melt - broke flask to remove material |

The product was melted at 190° C. and was a light tan to brown solid. The product (0.2 g) was added to 5 ml of water in a test tube and shaken. The product did not dissolve readily, but a good foaming mixture resulted. It dissolved on standing over night and the solution foamed nicely.

EXAMPLE 2

Polymerization of Triethylene Glycol Diamine-Adipic Acid Salt in the Presence of Liquid Detergent In this example 25 g of salt were heated with 100 g of (or four times the weight) of Surfonic ®N-85 detergent. The product consisted of a hard brown solid and a light brown liquid. In this experiment the polymerization was carried out at 245° C. for two hours at 1.5 mm. Air probably caused the darkened product. The liquid weighed 86.5 g. The solid was soluble in water and the wate solution foamed.

EXAMPLE 3

Polymerization of TEGDA-Adipic Acid Salt in the Presence of Powdered Heavy Duty Detergent To a 250-ml 3-necked flask equipped with a stirrer, thermometer, Dean-Stark trap and condenser was added 75 g of the TEGDA-adipic acid salt and 50 g of Arm and Hammer ® heavy duty powder detergent. The flask was heated to 105° C. at which point water began distilling and foaming resulted. The reactants were carefully heated to 239° C. and held at this temperature for 1.5 hours. The product was a tan solid which was insoluble in isopropanol. It was soluble in hot water and had the properties of a detergent bar.

EXAMPLE 4

Polymerization of Triethylene Glycol Diamine-Adipic Acid Salt in the Presence of Soap The Ivory ® soap bar darkened around 210° C. and decomposed at 230°-240° C. To a one liter resin flask equipped with a thermometer, magnetic stirrer, two nitrogen inlets and a take off arm was added 100 g of Ivory ® soap and 160 g of TEGDA-adipic acid salt and 40 g of hexamethylene diamine-adipic acid salt. The following data were recorded.

| Time, min. | Temp., °C. | Comments |
|---|---|---|
| — | — | Heat on to dissolve reactants |
| 50 | 125 | Liquid-one nitrogen inlet placed under liquid |
| 170 | 202 | Product white and creamy |
| 290 | 225 | Pressure 25 mm - somewhat foamy |
| 350 | 225 | Foamy above heated zone - cooled & pushed all product to bottom of flask |

The product was heated an additional 2.5 hours at 3.2-0.8 mm and 225° C. The resulting product was a hard, shiny, light tan solid. The product was heavier than water and formed a heavy, but low foaming solution. It dissolved much slower in water than a comparable piece of Ivory ® soap. This product was used to wash laboratory glassware.

EXAMPLE 5

Polymerization of Triethylene Glycol Diamine-Adipic acid salt in the presence of Detergent 40 g of Witconate ® 1250 (an alkylbenzene sulfonate) and 40 g of TEGDA-adipic acid salt was heated for one hour at 252°-253° C. A hard tan soap was obtained which was surprisingly tough and durable in spite of the short heating time.

EXAMPLE 6

Polymerization of Tetraethylene Glycol Diamine-Adipic Acid Salt in the Presence of Detergent Equal weights of the tetraethylene glycol diamine-adipic acid salt and Surfonic ® N-95 detergent (9.5 molar ethoxylate of nonylphenol) were heated at 250°-260° C. and 0.4 mm. pressure for two hours. Even though this treatment was very drastic; as evidenced by the odor of burned amines, a tan cake was obtained which wa used to wash laboratory glassware.

EXAMPLE 7

Polymerization of Salts made from Adipic Acid and Sebacic Acid with Triethylene glycol Diamine To a one liter resin flask was added 133 g of a salt made from adipic acid and triethylene glycol diamine, 33 g of the salt made from sebacic acid and triethylene glycol diamine and 166 g of Neodol ® 25-7. Neodol ® 25-7 is a liquid nonionic surfactant made by the ethoxylation of fatty alcohols and sold by Shell Chemical Co. The ingredients were heated for 2.5 hours at 200° C. and then for two hours at 250° C. The water formed was removed from the reaction flask. The product was tan to brown in color and was easily removed from the reaction flask. It weighed 301 g, had an odor of burned amine and had properties of a detergent bar when added to water.

EXAMPLE 8

Polymerization of TEGDA-Adipic Acid Salt in the Presence of Detergent

Equal weights of salt and Neodol ® 25-7 were heated with good stirring at 200° C. for two hours, then at 250° C. for one hour. Upon cooling, a nice tan solid detergent bar was obtained. A low foaming, soapy water solution was made from the bar.

EXAMPLE 9

(a) To a 250 ml round bottom flask equipped with a magnetic stirrer, thermometer, nitrogen inlet and Dean Stark trap was added 60 g of Surfonic ® N-85 detergent and 60 g of the salt made from sebacic acid and triethylene glycol diamine salt. The contents were flushed with nitrogen for 15 minutes and then heated to 234° C. and held at this temperature for three hours. During this period 8.6 ml of water was collected. The molten product was poured into a urethane elastomer soap dish mold. The resultant turtle-shaped soap dish was white and had a pleasant appearance. The product exhibited low water solubility. With time some surfactant was leached and a soap solution resulted. The material remaining in the flask was soaked with water for one week and fresh water added at intermittent intervals. After this a white polymer remained. The material was suitable for a bathtub toy or other shaped or molded article.

(b) Ivory ® soap (60 g) was heated with 150 ml of hydroxyacetic acid (70%) for two hours at 112°-114° C., then at 147°-219° C. for four hours while removing water and finally heated at 160° C. and 2 mm. The product was a relatively unattractive dark brown solid. It dissolved very slowly in water to give a foamy solution.

EXAMPLE 10

Linear water-soluble polyamide having ether linkages are preferred in our invention.

We found that a homogeneous solid could also be prepared from poly(4,7-dioxadecamethylene)adipamide and Surfonic® N-85 detergent (8.5 mole ethylene oxide adduct of nonylphenol). To a 250 ml 3-necked flask was added 31 lg of Surfonic® N-85 and 31 g of salt from this diamine and adipic acid. The mixture was stirred and heated for two hours at 220° C. and then for one hour at 240° C. and 1 mm. The hot product was poured into a jar and gave a solid cake on cooling.

Not all oxygen-containing diamines form water-soluble polyamides. Water solubility depends on the structure of the dicarboxylic acid also. You will note from Table I that very few of the polyamides are water-soluble.

TABLE I

Polyamides from Aminoethoxyalkyl Amines $NH_2(CH_2CH_2O)_x—CH_2CH_2NH_2$

| x = | Salt m.p., °C. | Polymer m.p., °C. | Water solubility | Appearance |
|---|---|---|---|---|
| | | | Glutaric | |
| 1 | 141–146 | 183 | Yes | Light yellow, brittle |
| 2 | 102–107 | 175 | Yes | Rather weak |
| 3 | Oil | 124 | Yes | Rather weak |
| | | | Adipic | |
| 1 | 157–158 | 204 | No | Tough polymer |
| 2 | 144–145 | 189 | Yes | Tough polymer |
| 3 | 99–101 | 132 and 146 | Yes | Tough, malleable |
| | | | Azelaic* | |
| 1 | 94–110 | 180 | No | Tough polymer |
| 2 | 102–112 | 159 | No | Tough polymer |
| 3 | 88–126 | 133 | No | Tough polymer |
| | | | Sebacic | |
| 1 | 118–122 | 183 | No | Attractive tough polymer |
| 2 | 133–134 | 151 | No | Very tough polymer |
| 3 | 81 | 137 | No | Tough polymer |
| | | | Dodecanedioic | |
| 1 | 94–94 | 182 | No | — |
| 2 | 128–129 | 159 | No | — |
| 3 | 103–107 | 114 | No | — |

*Purest commercial grade - 90% azelaic, 8% higher carbon dibasic, lower carbon dibasic.

While particular embodiments of the invention have been described, it will be understood that the invention is not limited thereto since modifications may be made and it is therefore contemplated to cover by the appended claims any such modifications as fall within the spirit and scope of the claims. For example, mixtures of polyamides and polyesters are envisioned. Also we have added small amounts of insoluble polyamides and polyesters and compatibilizing components to improve properties of the finished product.

What is claimed is:

1. A detergent bar comprising:

A. 5 to 95 wt % of a synthetic condensation polymer selected from the group consisting of the condensation reaction product of:

an acid selected from the group consisting of glutaric acid, pimelic acid, adipic acid, oxydiacetic acid and oxyalkylene homologues of oxydiacetic acid, with a diamine selected to yield a water-soluble condensation polymer and mixtures thereof;

B. a surface active agent as a major portion of the balance.

2. The detergent bar of claim 1 wherein the acid is selected from the group consisting of glutaric acid and adipic acid.

3. The detergent bar of claim 1 wherein the acid is adipic acid.

4. The detergent bar of claim 1 wherein the diamine is a polyethylene glycol diamine of molecular weight 148 to 2500.

5. The detergent bar of claim 1 wherein the diamine is a polyethylene glycol diamine of the formula:

$$NH_2(CH_2CH_2O)_xCH_2CH_2NH_2$$

wherein x ranges from 1 to 4.

6. The detergent bar of claim 1 wherein the diamine is triethylene glycol diamine.

7. The detergent bar of claim 1 wherein the diamine is triethylene glycol diamine and the acid is adipic acid.

8. The detergent bar of claim 1 wherein the diamine is tetraethylene glycol diamine.

9. The detergent bar of claim 1 wherein the diamine is tetraethylene glycol diamine and the acid is adipic acid.

10. The detergent bar of claim 1 wherein the diamine is a polyoxyalkylene diamine of the formula:

$$H_2NRNH_2$$

wherein: R is a radical of the formula $$—(CH(CH_3(CH_2O)_y(CH_2CH_2O)_z(CH_2CH(CH_3O)_{y-1}CH_2CH(CH_3)—$$

wherein: y ranges from 1 to 5 and z ranges from 1 to 50.

11. The detergent bar of claim 10 wherein y ranges from 1 to 3 and z ranges from 1 to 3.

12. The detergent bar of claim 1 wherein the diamine is a polyoxyalkylene diamine of the formula:

$$H_2NCH_2CH_2CH_2O—(CH_2CH_2O)_xCH_2CH_2CH_2NH_2$$

wherein x ranges from 1 to 100.

13. The detergent bar of claim 12 wherein x ranges from 1 to 3.

14. The detergent bar of claim 1 wherein the diamine is a (alkyleneoxy) bis(propylamine) of the formula:

$$H_2N—C_3H_6—(OR)_n—OC_3H_6—NH_2$$

wherein R is a radical selected from the group consisting of ethylene, 1,2-propylene and 1,3-propylene and n ranges from 2 to 13.

15. The detergent bar of claim 1 wherein the diamine is of the formula $NH_2(CH_2)_nNH_2$ wherein n ranges from 2 to 10.

16. The detergent bar of claim 1 which additionally comprises wate insoluble polyamide.

17. A process for preparing a detergent bar according to claim 1 comprising polymerizing a water-soluble polyamide in the presence of a surface active agent and molding on shaping the composition.

18. The process of claim 17 wherein the polyamide comprises 30 to 70 wt % of the detergent bar.

19. A process for preparing a detergent bar according to claim 1 comprising melt blending a water-soluble polyamide in the presence of a highly dispersed surface active agent and molding or shaping the composition.

20. The process of claim 19 wherein the polyamide comprises 30 to 70 wt % of the detergent bar.

21. A molded or shaped article comprising:

A. 5 to 95 wt % of a synthetic condensation polymer selected from the group consisting of the condensation reaction product of:

1. an acid selected from the group consisting of glutaric acid, pimelic acid, adipic acid, oxydiacetic acid and oxyalkylene homologues of oxydiacetic acid, with
2. a diamine selected to yield a water-soluble condensation polymer and mixtures thereof;

B. a surface active agent as a major portion of the balance.

22. A cleaning composition in toy form comprising:

A. 5 to 95 wt % of a synthetic condensation polymer selected from the group consisting of the condensation reaction product of:

1. an acid selected from the group consisting of glutaric acid, pimelic acid, adipic acid, oxydiacetic acid and oxyalkylene homologues of oxydiacetic acid, with
2. a diamine selected to yield a water-soluble condensation polymer and mixtures thereof;

B. a surface active agent as a major portion of the balance.

23. A detergent bar comprising;

A. 5 to 95 wt % of the watere soluble condensation reaction product of:

1. oxalic acid and
2. tetraethylene glycol diamine, and

B. a surface active agent as a major portion of the balance.

* * * * *